US009615406B2

(12) United States Patent
Tabuchi

(10) Patent No.: US 9,615,406 B2
(45) Date of Patent: Apr. 4, 2017

(54) IMAGE FORMING APPARATUS WITH ELECTROMAGNETIC INDUCTION HEATING TYPE FIXING UNIT

(75) Inventor: Hidetaka Tabuchi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 698 days.

(21) Appl. No.: 13/279,684

(22) Filed: Oct. 24, 2011

(65) Prior Publication Data

US 2012/0145692 A1 Jun. 14, 2012

(30) Foreign Application Priority Data

Dec. 14, 2010 (JP) ..... 2010-278397

(51) Int. Cl.

| | |
|---|---|
| ***H05B 6/14*** | (2006.01) |
| ***H05B 6/10*** | (2006.01) |
| ***H05B 1/02*** | (2006.01) |
| ***G03G 15/20*** | (2006.01) |
| ***H05B 3/06*** | (2006.01) |

(52) U.S. Cl.

CPC ..... *H05B 3/06* (2013.01); *H05B 6/145* (2013.01)

(58) Field of Classification Search

CPC ... H05B 1/00; H05B 3/00; H05B 1/02; H05B 6/14; H05B 6/22; H05B 6/36; H05B 6/145; H05B 6/10; G03G 15/20; G03G 15/01

USPC ..... 219/216, 619, 649, 676, 482, 490, 494; 399/328, 329, 334, 67–70

See application file for complete search history.

(56) References Cited

U.S. PATENT DOCUMENTS

| | | | | |
|---|---|---|---|---|
| 6,373,232 | B1 * | 4/2002 | Mano et al. | 323/282 |
| 6,987,251 | B2 * | 1/2006 | Fukushi et al. | 219/619 |
| 8,139,971 | B2 * | 3/2012 | Yamamoto | 399/70 |
| 2005/0173416 | A1 * | 8/2005 | Fukushi | H05B 6/145 219/619 |
| 2006/0088324 | A1 * | 4/2006 | Fujimoto et al. | 399/33 |
| 2006/0198672 | A1 * | 9/2006 | Kinouchi et al. | 399/334 |

(Continued)

FOREIGN PATENT DOCUMENTS

| | | |
|---|---|---|
| JP | 2000-223253 A | 8/2000 |
| JP | 2004-325678 A | 11/2004 |

OTHER PUBLICATIONS

English translation of JP 2004-325678 to OOmoto published Nov. 18, 2004.*

(Continued)

*Primary Examiner* — Michael Laflame, Jr.

(74) *Attorney, Agent, or Firm* — Fitzpatrick, Cella, Harper & Scinto

(57) ABSTRACT

An image forming apparatus including a magnetic flux generating device, a fixing unit configured to heat in accordance with the magnetic flux from the magnetic flux generating device, the fixing unit having a heating element including a magnetic material, a current detection unit configure to detect a value of a current supplied to the magnetic flux generating device, a temperature sensor configure to detect a temperature of the heating element, and an abnormal status detecting unit configured to detect an abnormal status of the current based on a result of comparison between the value of the current detected by the current detection unit and a threshold is provided. The abnormal status detecting unit is configured to vary the threshold based on the temperature detected by the temperature sensor.

6 Claims, 12 Drawing Sheets

(56) References Cited

U.S. PATENT DOCUMENTS

| | | | | |
|---|---|---|---|---|
| 2007/0127958 | A1* | 6/2007 | Matsuura et al. | 399/328 |
| 2007/0212091 | A1* | 9/2007 | Kinouchi et al. | 399/69 |
| 2009/0238593 | A1* | 9/2009 | Kinouchi et al. | 399/67 |

OTHER PUBLICATIONS

English translation of JP 2000-223253 to Hayashizaki published Aug. 11, 2000.*

* cited by examiner

IMAGE FORMING APPARATUS WITH ELECTROMAGNETIC INDUCTION HEATING TYPE FIXING UNIT

BACKGROUND OF THE INVENTION

Field of the Invention

The present invention relates to an image forming apparatus with an electromagnetic induction heating type fixing unit to fix a formed image.

Description of the Related Art

An electrophotographic image forming apparatus generally includes a fixing unit which adds heat and pressure to fix a toner image transferred on a printing medium to a sheet such as paper. Recently, a method of heating by electromagnetic induction has started to be used in fixing units.

An image forming apparatus has the problem that the temperature at the end of a fixing roller rises more than necessary when an image is formed on a printing medium of a relatively small size such as B5 size because no sheet removes heat from the fixing roller in a non-passage area where the sheet does not pass at the end of the fixing roller of the fixing unit. To solve this problem, Japanese Patent Laid-Open No. 2004-325678 discloses an arrangement which uses a Curie material for the fixing roller to suppress a temperature rise in the non-passage area. The Curie material is a magnetic shunt alloy having a characteristic in which magnetism abruptly drops when the temperature reaches the Curie temperature. In an area where magnetism drops, induction heating hardly occurs, decreasing the amount of generated heat.

If an abnormal status, such as a short circuit, occurs in a coil for heating by electromagnetic induction, a large current may flow through the coil via a switching element to damage the power source device. To prevent this, Japanese Patent Laid-Open No. 2000-223253 discloses an arrangement which detects an output current flowing through the coil, and when the output current enters an overcurrent state, the image forming apparatus determines that the fixing unit has become abnormal, and stops the operation.

The impedance of a fixing unit using a Curie material has a characteristic in which it abruptly varies near the Curie temperature. Note that an impedance in an area where the temperature of the fixing unit is higher than the Curie temperature is lower than an impedance in an area where it is lower than the Curie temperature. If output power to the fixing unit is constant, a current flowing through the fixing unit increases abruptly when the temperature of the fixing unit exceeds the Curie temperature.

If a threshold to detect the abnormal status of an output current to the fixing unit is determined by an output current at the Curie temperature or higher, output power to the fixing unit becomes excessively large in an abnormal status at the Curie temperature or lower. An overpower detection circuit may be attached to the power source device to prevent excessive output power. However, a complicated hardware circuit is required, increasing the circuit area and substrate cost.

SUMMARY OF THE INVENTION

The present invention has been made to solve the above problems, and provides an image forming apparatus capable of determining the abnormal status of an output current to a fixing unit accurately regardless of temperature variations by adding a simple circuit.

According to one aspect of the present invention, an image forming apparatus includes a magnetic flux generating device which is configured to generate a magnetic flux; a fixing unit which has a heating element including a magnetic material and is configured to heat in accordance with the magnetic flux from the magnetic flux generating device; a power source which is configured to supply a current to the magnetic flux generating device; a current detection unit which is configured to detect a value of the current supplied to the magnetic flux generating device; a temperature sensor which is configured to detect a temperature of the heating element; and an abnormal status detecting unit which is configured to detect an abnormal status of the current based on a result of comparison between the value of the current detected by the current detection unit and a threshold. The abnormal status detecting unit is configured to vary the threshold based on the temperature detected by the temperature sensor.

According to one aspect of the present invention, the abnormal status detecting unit is configured to vary the threshold based on whether the temperature detected by the temperature sensor exceeds a Curie temperature of the magnetic material.

Further features of the present invention will become apparent from the following description of exemplary embodiments with reference to the attached drawings.

DESCRIPTION OF THE EMBODIMENTS

Preferred embodiments of the present invention will now be described in detail with reference to the accompanying drawings.

Figure 1:
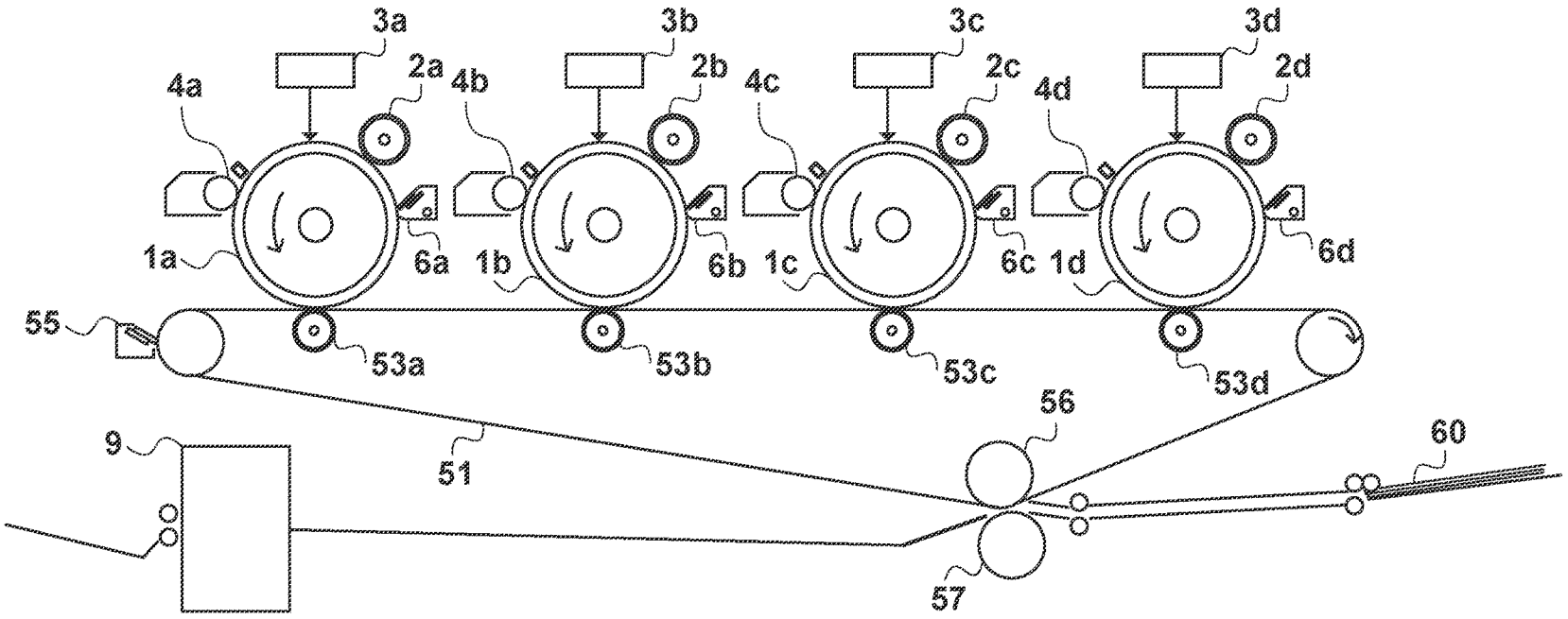
FIG. 1 is a view showing the schematic arrangement of an image forming apparatus.

An image forming apparatus to which the present invention is applied will be explained. Referring to FIG. 1, charging units 2*a* to 2*d* uniformly charge photosensitive bodies 1*a* to 1*d*. Then, exposure units 3*a* to 3*d* perform exposure in accordance with image signals, forming electrostatic latent images on the photosensitive bodies 1*a* to 1*d*. Developing units 4*a* to 4*d* develop the electrostatic latent images into toner images. The toner images on the four photosensitive bodies 1*a* to 1*d* are transferred onto an intermediate transfer belt 51 by primary transfer portions 53*a* to 53*d* to overlap each other. The toner image on the intermediate transfer belt 51 is further transferred onto a printing sheet 60 by secondary transfer portions 56 and 57. Cleaners 6*a* to 6*d* recover toner which has not been transferred onto the intermediate transfer belt 51 and remain on the photosensitive bodies 1*a* to 1*d*. Similarly, an intermediate transfer belt cleaner 55 recovers toner which has not been transferred onto the printing sheet 60 and remains on the intermediate transfer belt 51. An electromagnetic induction heating type fixing unit 9 fixes the toner image transferred on the printing sheet 60.

Figure 2:
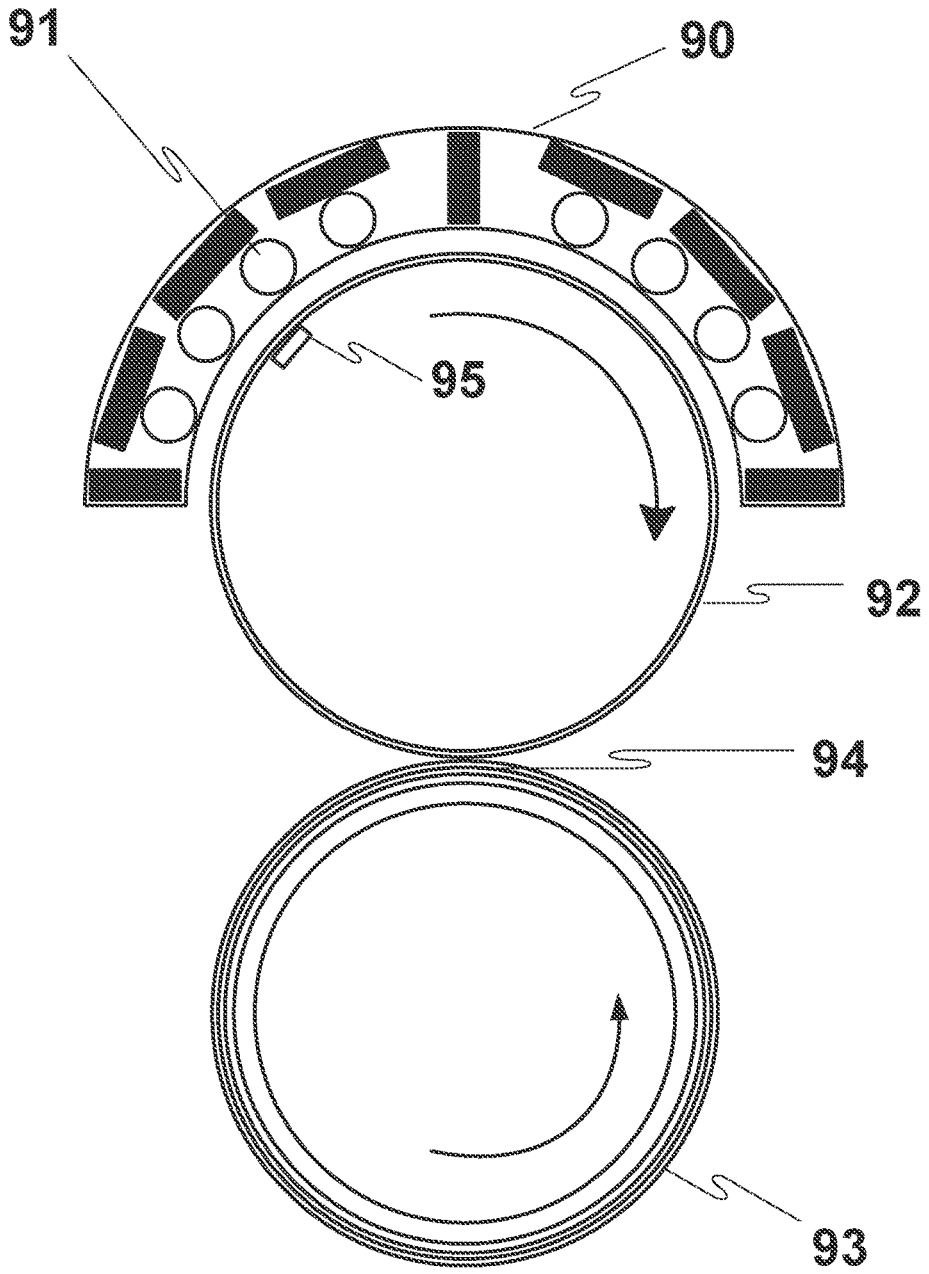
FIG. 2 is a view showing the arrangement of a fixing unit.

FIG. 2 shows the arrangement of the fixing unit 9. The fixing unit 9 includes a fixing roller 92 obtained by covering the surface of a conductive heating element with a rubber layer. The conductive heating element of the fixing roller 92 is, for example, 45 μm thick, and the rubber layer on the surface is, for example, 300 μm thick. The fixing roller 92 forms a nip 94 together with a driving roller 93. The fixing roller 92 rotates in a direction indicated by the arrow in FIG. 2 along with rotation of the driving roller 93 that is transmitted via the nip 94. A coil 91, serving as a magnetic flux generating device, is incorporated in a coil holder 90 to face the fixing roller 92. An AC current is supplied to the coil 91 to generate a magnetic flux. Then, the fixing roller 92 generates heat by an eddy current. A temperature sensor 95 formed from a thermistor or the like is arranged inside the conductive heating element of the fixing roller 92, and detects the temperature of the fixing roller 92.

Figure 3:
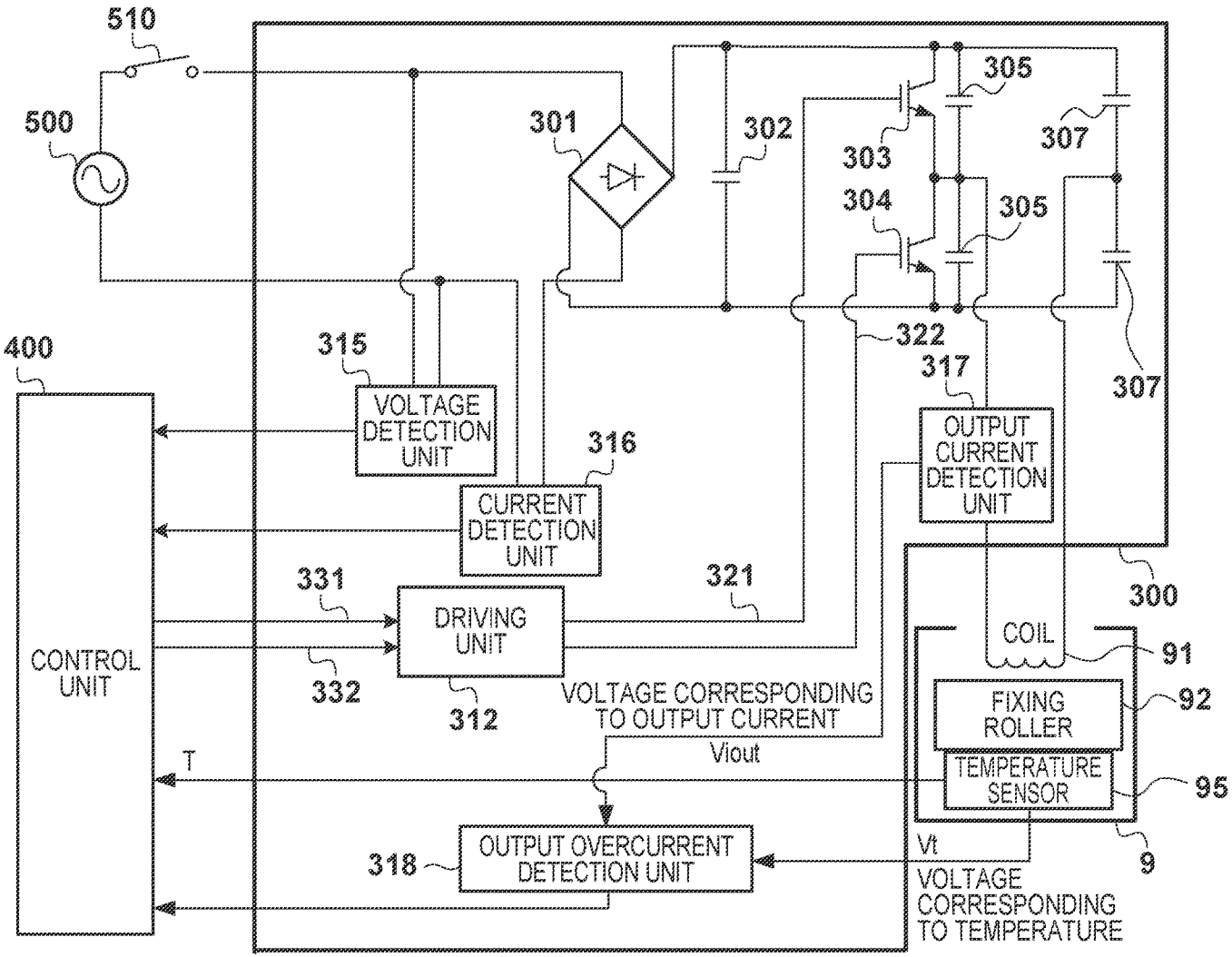
FIG. 3 is a functional block diagram showing the fixing unit and a power source device.

FIG. 3 shows a power source device which supplies power to the fixing unit 9. A power source device 300 is connected to a commercial power source 500. An output from the commercial power source 500 is converted into a DC current by a diode bridge 301 and filter capacitor 302. A voltage detection unit 315 and current detection unit 316 detect an input voltage and input current supplied from the commercial power source 500, respectively, and output the detection values to a control unit 400. The control unit 400 controls a series of operations of the image forming apparatus. Based on the detection values of the voltage detection unit 315, the current detection unit 316, an output overcurrent detection unit 318, and the temperature sensor 95, the control unit 400 generates a first driving signal 331 and second driving signal 332 and outputs them to a driving unit 312.

The driving unit 312 amplifies the first driving signal 331 and second driving signal 332, and outputs a first control signal 321 and second control signal 322. A first switching element 303 and second switching element 304 are alternately turned on/off in accordance with the first control signal 321 and second control signal 322, and supply high-frequency currents to the coil 91. When the high-frequency currents flow through the coil 91, an eddy current is induced by an AC magnetic field generated by the coil 91, generating Joule heat and heating the fixing roller 92. Note that the power source device 300 includes a resonant capacitor 307 to form a resonant circuit with the coil 91. Also, capacitors 305 are arranged to suppress the losses of the first switching element 303 and second switching element 304.

Figure 4:
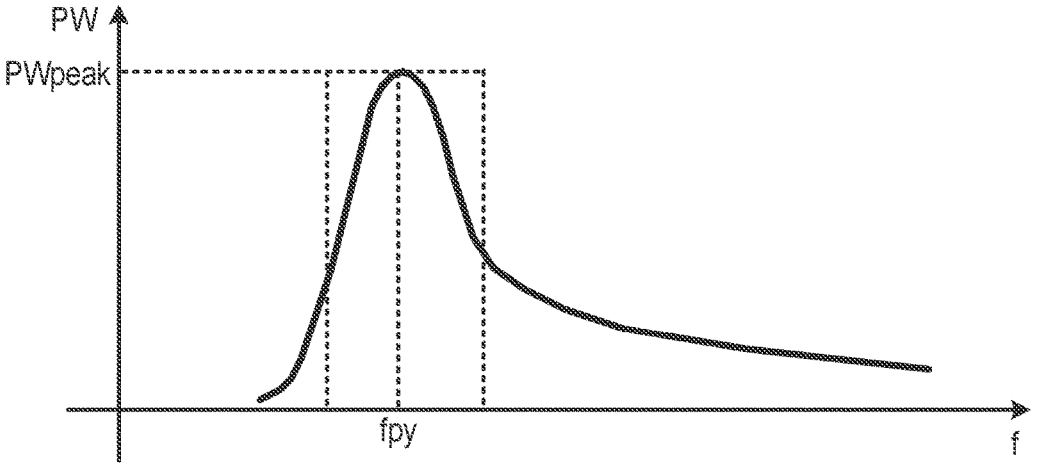
FIG. 4 is a graph showing the relationship between the driving frequency and power in the power source device.

As shown in FIG. 4, the relationship between the frequency of the driving signal of the power source device 300 and input power draws a curve having maximum power PWpeak at a resonant frequency fpy. Power to be supplied to the fixing unit 9 can be controlled by controlling a driving frequency f of the first driving signal 331 and second driving signal 332 using the curve characteristic shown in FIG. 4.

Figure 5:
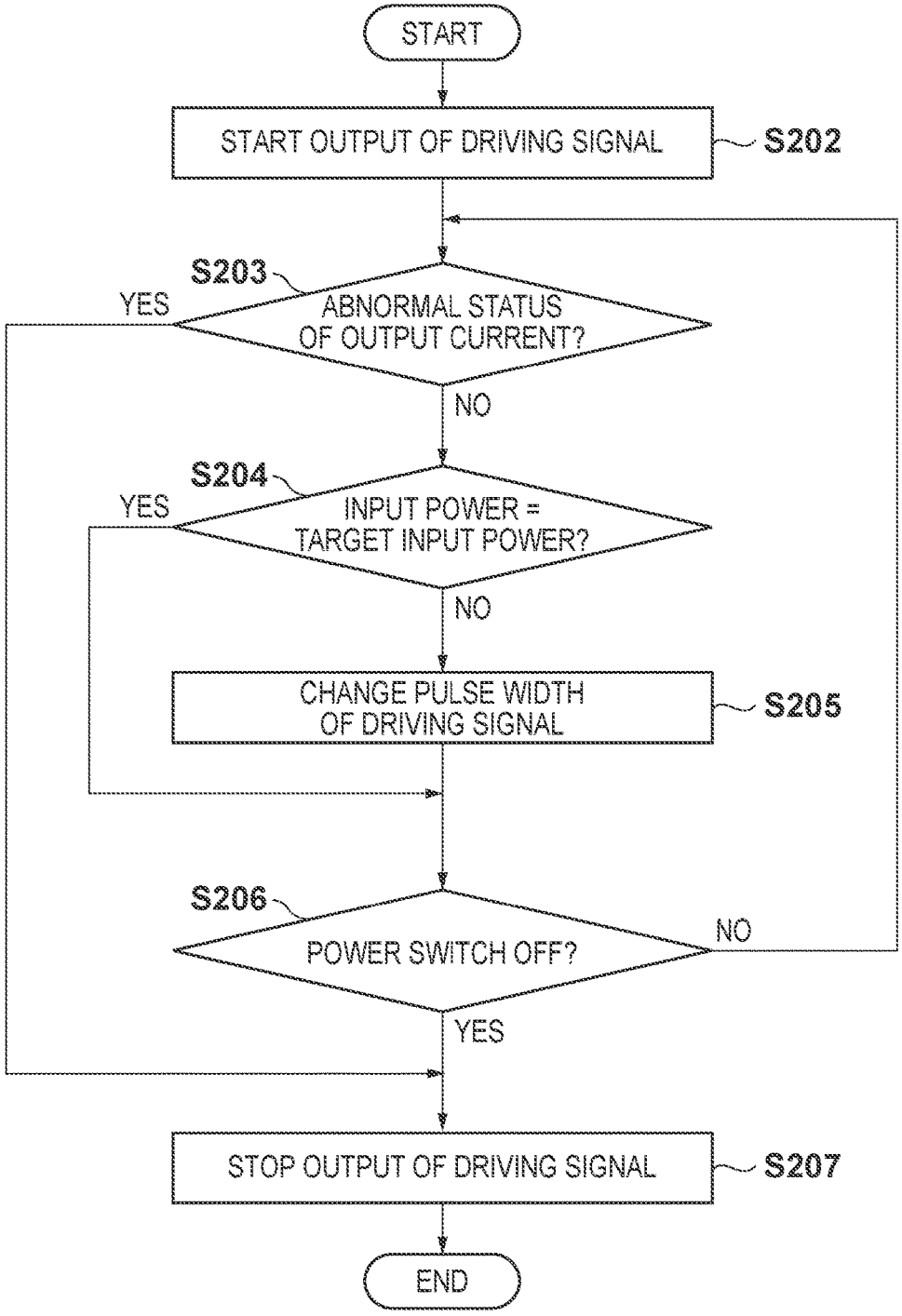
FIG. 5 is a flowchart showing processing in a control unit.

Next, the process of controlling output power of the power source device 300 to the fixing unit 9 by the control unit 400 will be explained with reference to FIG. 5. When the operation starts, the control unit 400 starts output of the first driving signal 331 and second driving signal 332 in step S202. In step S203, the control unit 400 determines whether the output overcurrent detection unit 318 outputs a signal indicating the abnormal status of an output current to the fixing unit 9. Details of the output overcurrent detection unit 318 will be described later. If the output overcurrent detection unit 318 outputs a signal indicating an abnormal status, the control unit 400 stops output of the first driving signal 331 and second driving signal 332 in step S207. If the output overcurrent detection unit 318 does not output a signal indicating an abnormal status, the control unit 400 determines in step S204 whether output power to the fixing unit 9 has reached a target value. If input power of the power source device 300 has reached a target value, it is determined that output power to the fixing unit 9 has reached a target value. Note that the input power is calculated from values outputted by the voltage detection unit 315 and the current detection unit 316. If the input power has not reached the target value, the control unit 400 changes the pulse widths of the first driving signal 331 and second driving signal 332 in step S205 to reach the target value. More specifically, the pulse widths of the first driving signal 331 and second driving signal 332 are increased when the input power is larger than the target value, and decreased when it is smaller. If the input power has reached the target value, no pulse width is changed. Also when a power switch 510 is turned off in step S206, supply of the first driving signal 331 and second driving signal 332 is stopped.

Figure 6A:
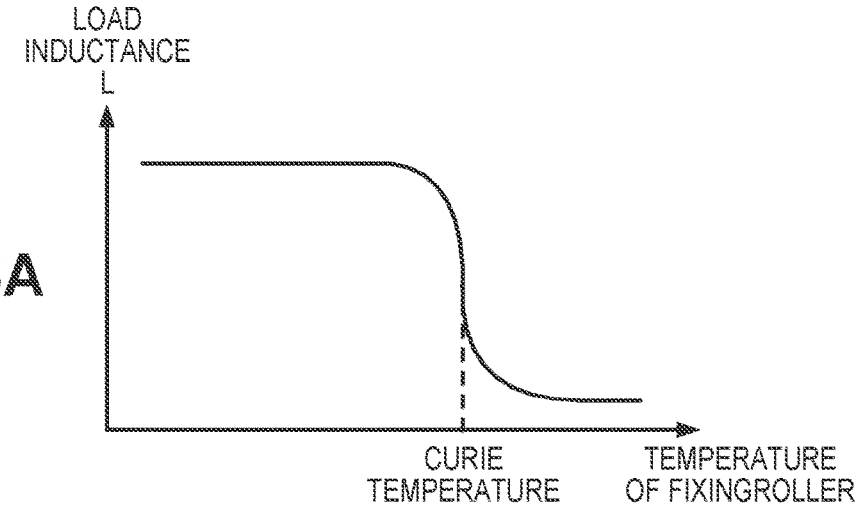
FIGS. 6A, 6B, and 6C are graphs showing changes of the load inductance, load resistance, and output current, respectively, when viewed from the power source device upon a change of the temperature of a fixing roller.
Figure 6B:
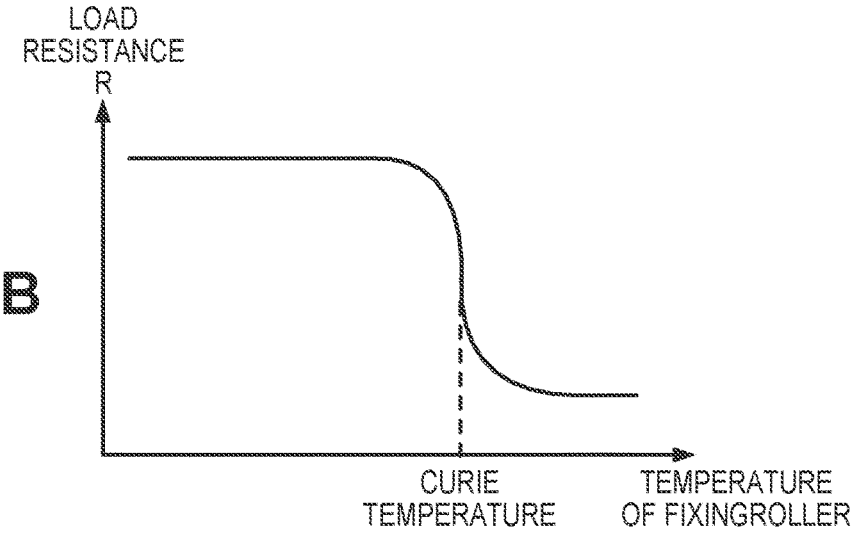

Referring back to FIG. 3, the fixing roller 92 is made of a magnetic material and, more specifically, a magnetic shunt alloy having a Curie temperature (for example, 230° C.). The magnetic shunt alloy stops spontaneous magnetization when it reaches the Curie temperature. As shown in FIGS. 6A and 6B, the load inductance L and load resistance R of the fixing unit 9 abruptly vary when the temperature of the fixing roller 92 reaches the Curie temperature. More specifically, when the temperature of the fixing roller 92 exceeds the Curie temperature, the load inductance L and load resistance R of the fixing unit 9 decrease abruptly.

An output current Iout to the fixing unit 9, output power Pout, and the load resistance R have the following relation:

$$I\text{out}=\sqrt{P\text{out}/R}$$

Figure 6C:
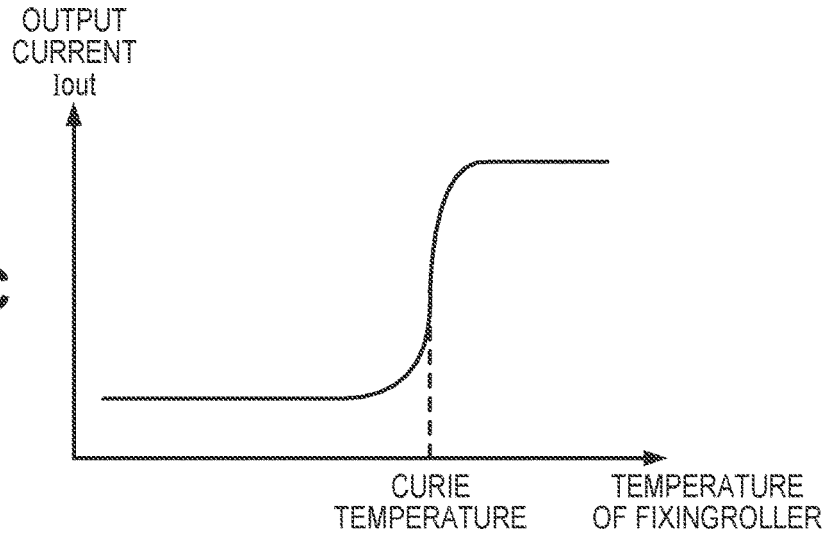

As shown in FIG. 6C, when the temperature of the fixing roller 92 exceeds the Curie temperature, the output current Iout increases abruptly.

Figure 7:
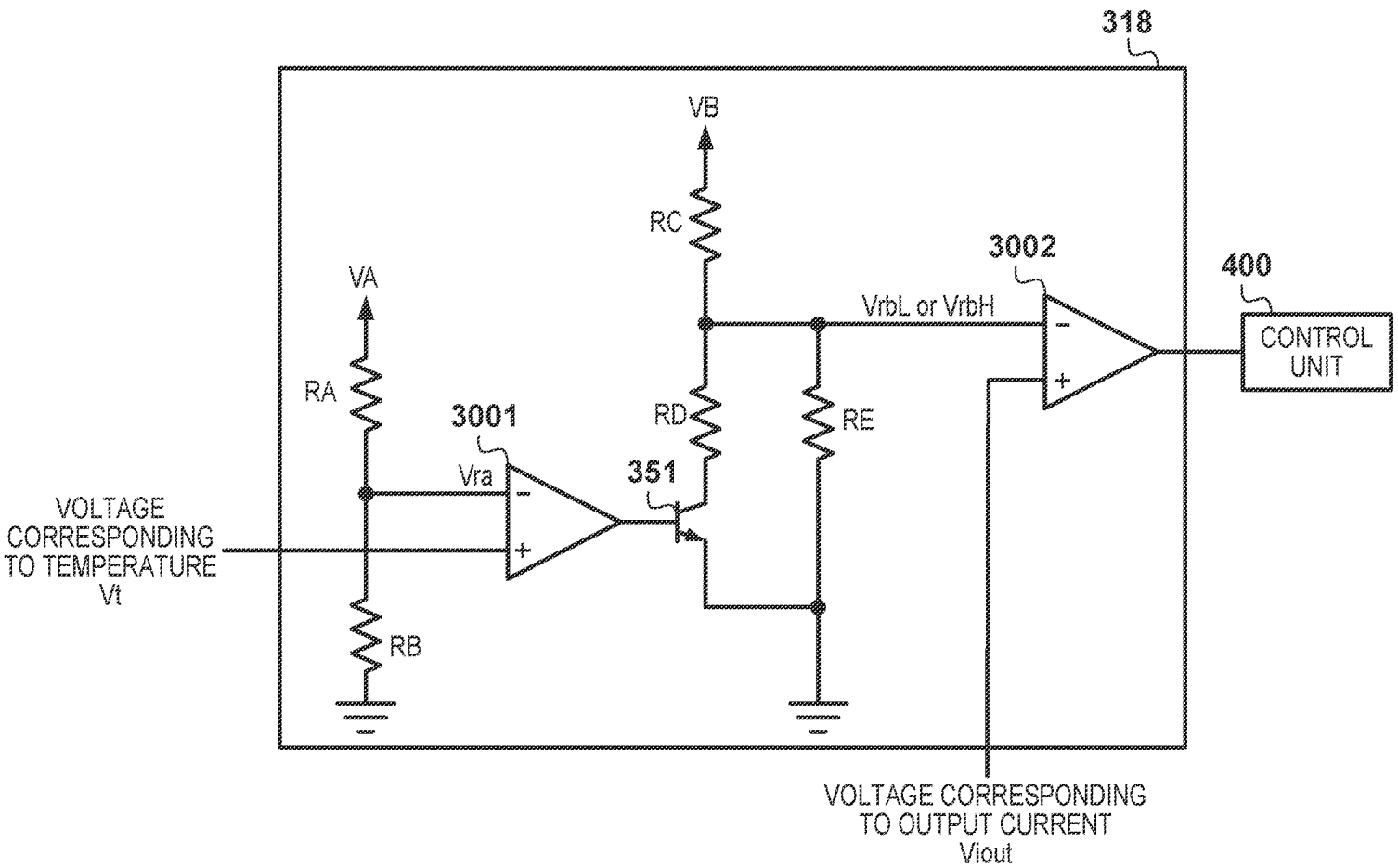
FIG. 7 is a circuit diagram showing the arrangement of an output overcurrent detection unit.

Subsequently, the output overcurrent detection unit 318 which detects the abnormal status of an output current to the fixing unit 9 in the present invention will be explained. FIG. 7 is a circuit diagram showing the arrangement of the output overcurrent detection unit 318 in FIG. 3. In FIG. 7, a voltage Vt corresponding to the temperature of the fixing roller 92 that is detected by the temperature sensor 95 is input to one input of a first comparator 3001. A reference voltage Vra is input to the other input of the first comparator 3001. Note that the reference voltage Vra is generated by dividing a voltage VA by a resistor. The reference voltage Vra is given by $$Vra=(RB\cdot VA)/(RA+RB)$$

In this case, Vra is set to be equal to the voltage Vt corresponding to temperature that is output from the temperature sensor 95 at the Curie temperature. In the embodiment, the temperature sensor 95 decreases the voltage Vt corresponding to temperature as a detected temperature rises.

Hence, when the temperature of the fixing roller 92 is lower than the Curie temperature, the voltage Vt corresponding to temperature becomes larger than Vra and an output from the first comparator 3001 becomes High. In response to this, a third switching element 351 is turned on. On the other hand, when the temperature of the fixing roller 92 is equal to or higher than the Curie temperature, the voltage Vt corresponding to the temperature becomes smaller than or equal to Vra and an output from the first comparator 3001 becomes Low. Then, the third switching element 351 is turned off. That is, the first comparator 3001 controls the ON/OFF state of the third switching element 351 based on the voltage Vt corresponding to temperature.

A voltage Viout corresponding to an output current to the fixing unit 9 that is detected by an output current detection unit 317 is input to one input of a second comparator 3002. A reference voltage serving as a threshold is input to the other input of the second comparator 3002. Note that the threshold input to the second comparator 3002, that is, the reference voltage is generated by dividing, by a resistor, a voltage VB applied to a circuit network including a plurality of resistors and the third switching element 351. At this time, the third switching element 351 varies the reference voltage to be output to the second comparator 3002 based on the ON/OFF state of the third switching element 351. Thus, the threshold to the second comparator 3002 changes depending on whether the temperature of the fixing roller 92 that is detected by the temperature sensor 95 is equal to or higher than the Curie temperature. Note that the output current detection unit 317 increases the voltage Viout corresponding to output current as an output current increases.

More specifically, when the temperature of the fixing roller 92 is lower than the Curie temperature, a threshold VrbL input to the second comparator 3002 is given by $$VrbL=(RD\cdot RE\cdot VB)/(RC\cdot RD+RD\cdot RE+RC\cdot RE)$$

When the temperature of the fixing roller 92 is equal to or higher than the Curie temperature, a threshold VrbH input to the second comparator 3002 is given by $$VrbH=(RE\cdot VB)/(RC+RE)$$

In the embodiment, the threshold VrbL is set based on an output current obtained when the temperature of the fixing roller 92 is lower than the Curie temperature. The threshold VrbH is set based on an output current obtained when the temperature of the fixing roller 92 is equal to or higher than the Curie temperature. That is, the threshold VrbH is set larger than the threshold VrbL. Note that the thresholds VrbL and VrbH can be determined so that output power to the coil 91 of the fixing unit 9, when an abnormal status is detected by threshold determination, becomes constant, regardless of whether the temperature of the fixing roller 92 is lower than the Curie temperature. In other words, an output power value obtained when the temperature of the fixing roller 92 is lower than the Curie temperature and a current corresponding to the threshold VrbL flows is set to be equal to an output power value obtained when the temperature of the fixing roller 92 is equal to or higher than the Curie temperature and a current corresponding to the threshold VrbH flows.

When the temperature of the fixing roller 92 is lower than the Curie temperature, the second comparator 3002 determines, based on the threshold VrbL, whether an output current detected by the output current detection unit 317 is normal. In contrast, when the temperature of the fixing roller 92 is equal to or higher than the Curie temperature, the second comparator 3002 determines, based on the threshold VrbH, whether an output current is normal. The second comparator 3002 outputs the determination result to the control unit 400.

Figure 8:
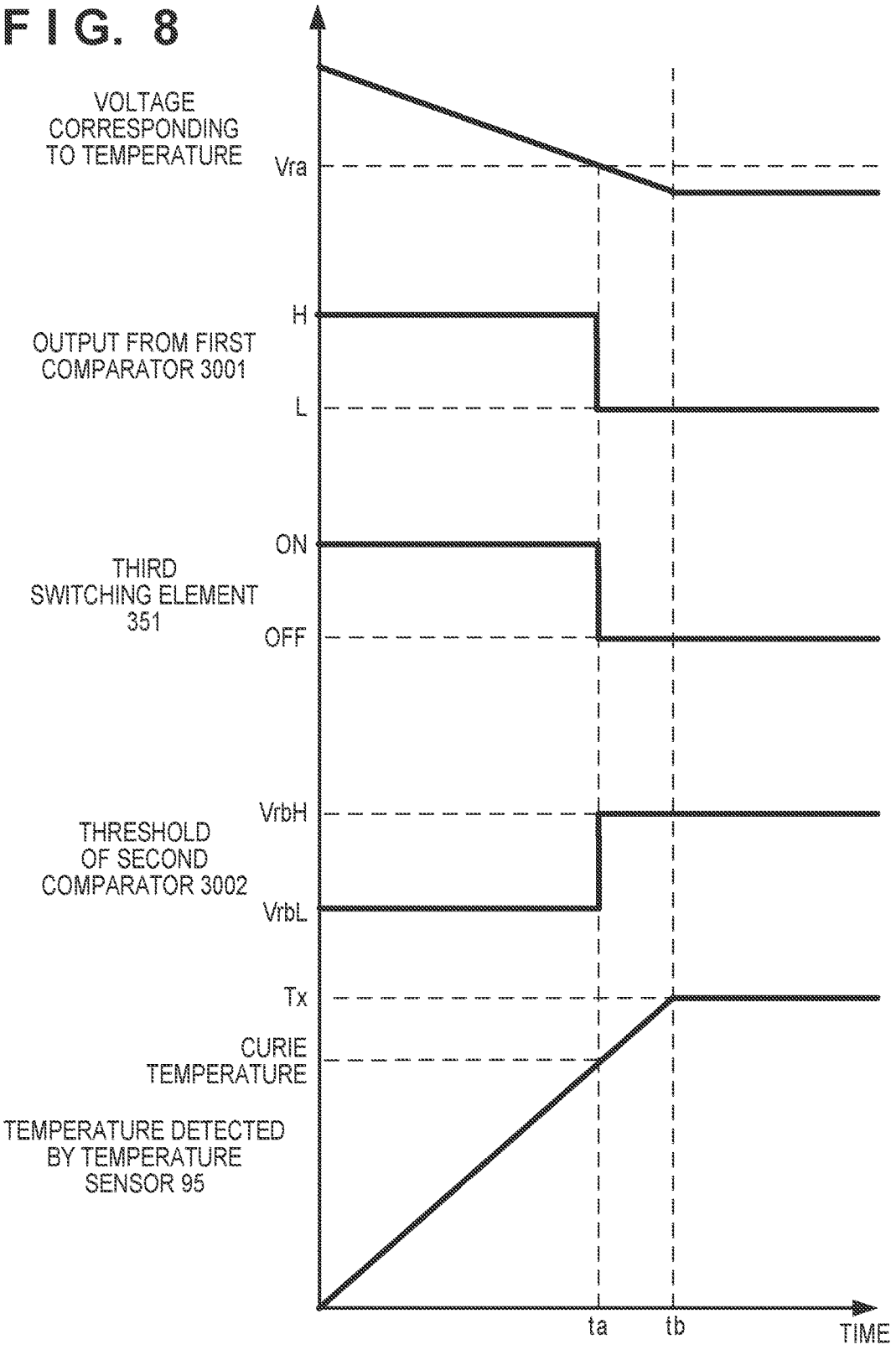
FIG. 8 is a chart showing the waveform of each portion of the apparatus in a warm-up state.

As shown in FIG. 8, when the power switch 510 of the power source device 300 is turned on, the fixing roller 92 is heated and the temperature of the fixing roller 92 rises. Then, the voltage Vt corresponding to temperature drops, and when the temperature of the fixing roller 92 reaches the Curie temperature at time ta, an output from the first comparator 3001 changes from High to Low. Along with this, the third switching element 351 changes from the ON state to the OFF state. A threshold input to the second comparator 3002 therefore changes from VrbL to VrbH. Even after that, the fixing roller 92 is heated and its temperature reaches a temperature Tx at time tb. When the temperature of the fixing roller 92 reaches the temperature Tx, the control unit 400 changes to the standby state, and controls the power source device 300 to maintain the fixing roller 92 at the temperature Tx.

Figure 9:
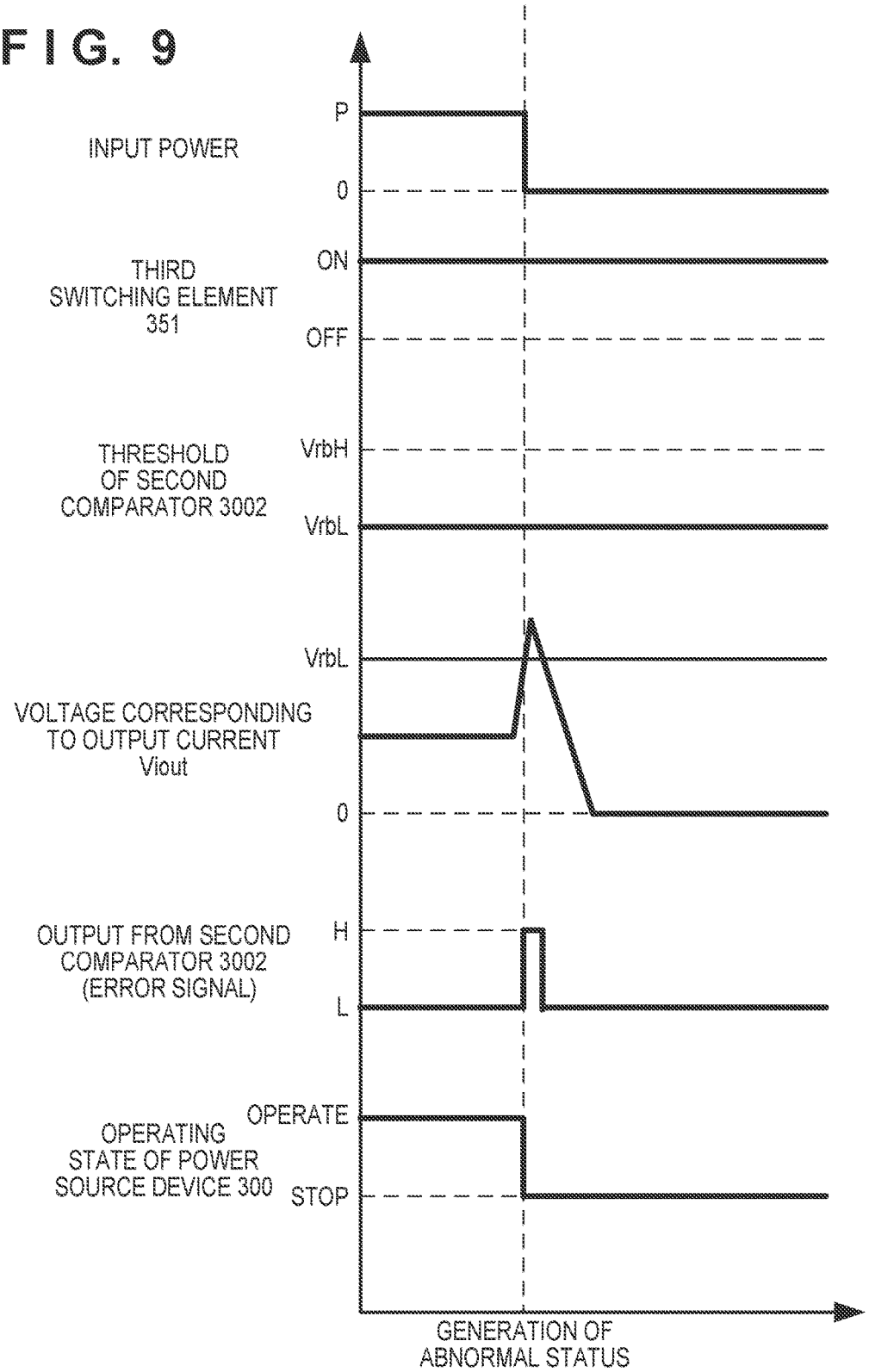
FIG. 9 is a chart showing the state of each portion of the apparatus when an output current enters an overcurrent state at a temperature lower than the Curie temperature.

Next, the operations of the power source device 300 and control unit 400 when an abnormal status occurs in the fixing unit 9 will be explained. In FIG. 9, assume that the temperature of the fixing roller 92 is lower than the Curie temperature. As described above, the third switching element 351 is ON, and a threshold input to the second comparator 3002 is VrbL. If an abnormal status occurs in the coil 91 and an output current enters an overcurrent state, the voltage Viout corresponding to output current that is input from the output current detection unit 317 to the second comparator 3002 rises. If the voltage Viout corresponding to output current exceeds VrbL, an output from the second comparator 3002 changes from Low to High, and an error signal indicating an abnormal status is input to the control unit 400. The control unit 400 stops the operation of the power source device 300, as described above with reference to FIG. 5.

Figure 10:
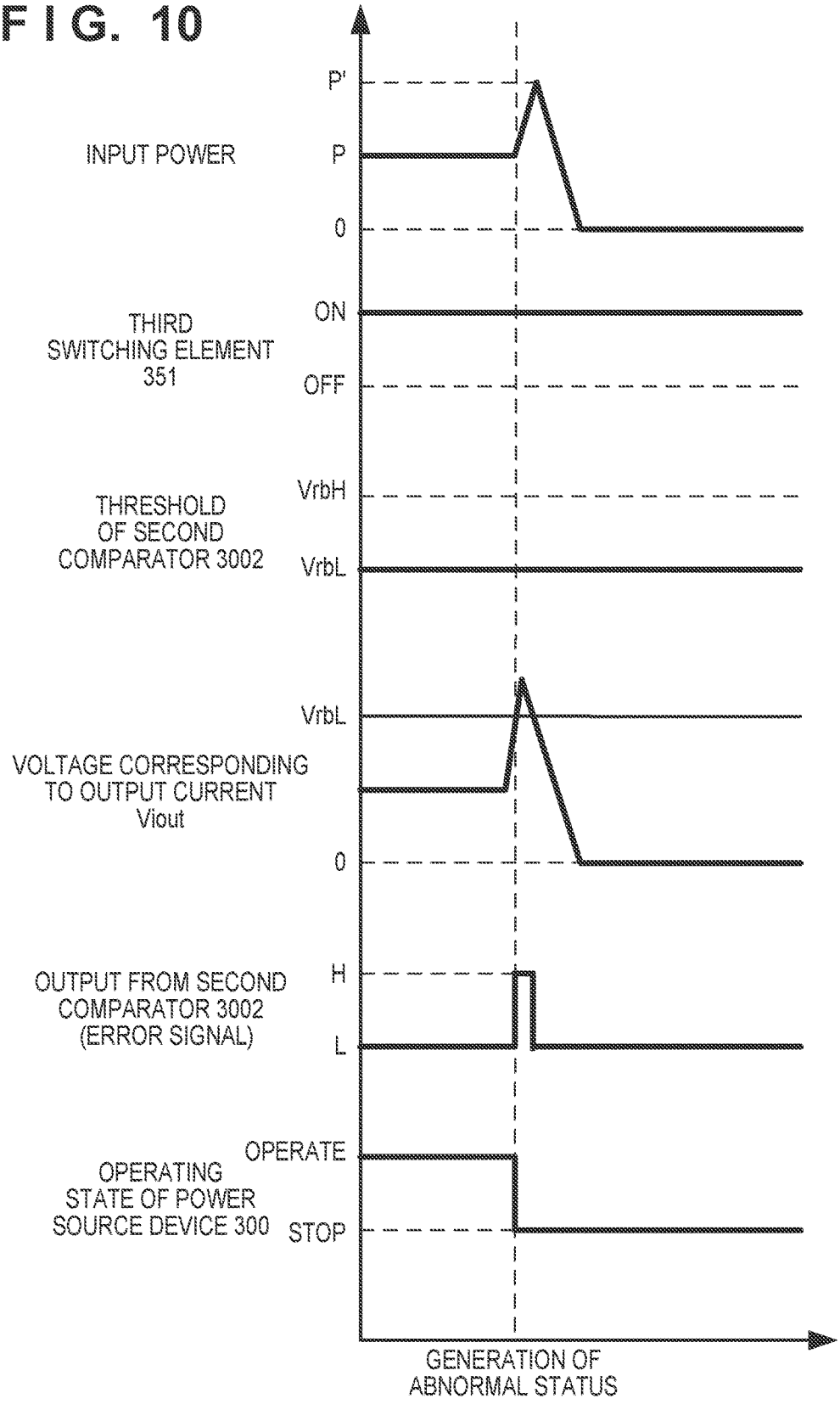
FIG. 10 is a chart showing the state of each portion of the apparatus when input power to the power source device enters an overcurrent state at a temperature lower than the Curie temperature.

In FIG. 10, assume that the temperature of the fixing roller 92 is lower than the Curie temperature. As described above, the third switching element 351 is ON, and a threshold input to the second comparator 3002 is VrbL. If input power enters an overcurrent state, a current flowing through the coil 91 also increases, and the voltage Viout corresponding to output current that is input from the output current detection unit 317 to the second comparator 3002 rises. If the voltage Viout corresponding to output current exceeds VrbL, an output from the second comparator 3002 changes from Low to High, and an error signal indicating an abnormal status is input to the control unit 400. Thus, the control unit 400 stops the operation of the power source device 300, as described above with reference to FIG. 5.

Figure 11:
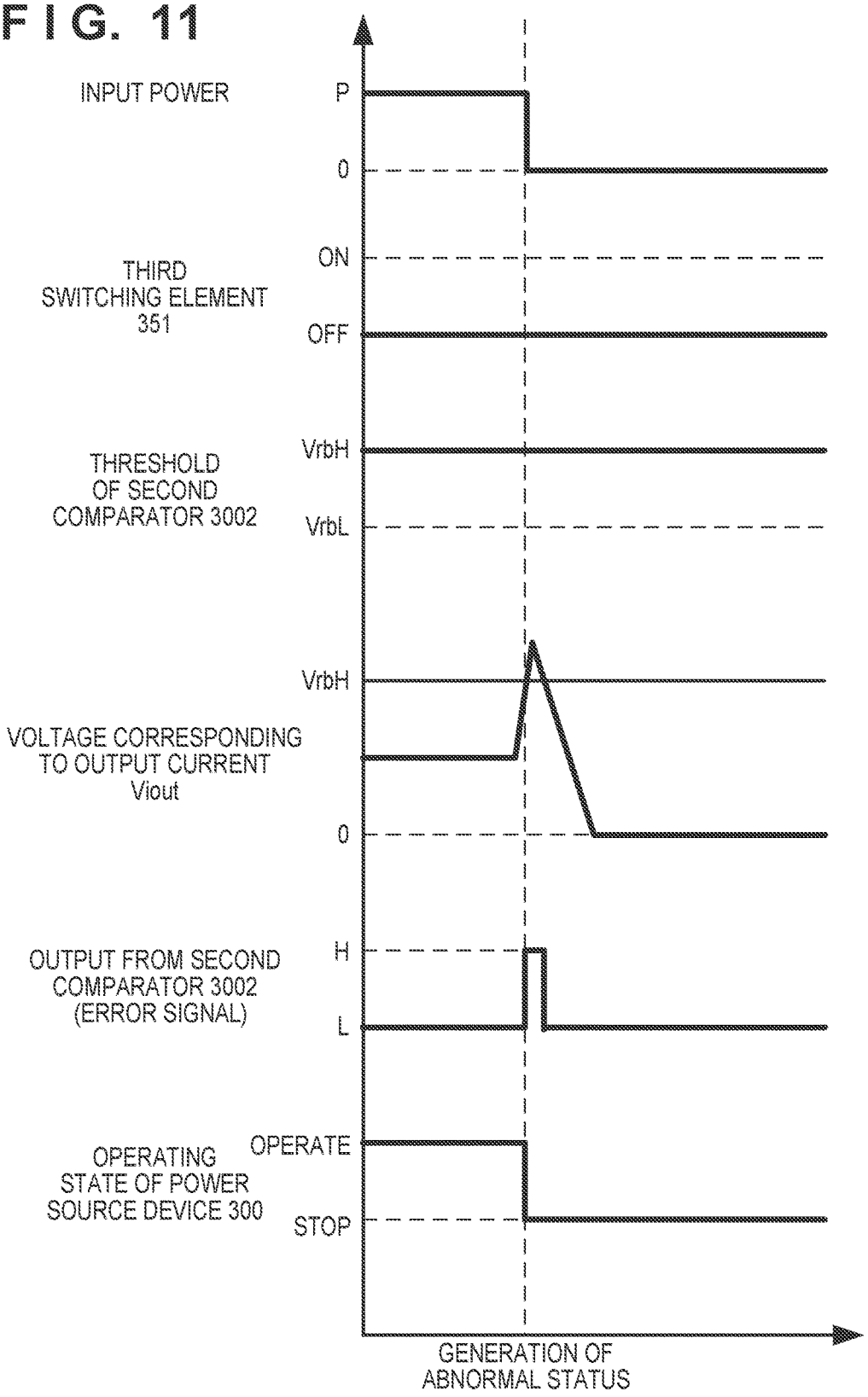
FIG. 11 is a chart showing the state of each portion of the apparatus when an output current enters an overcurrent state at a temperature equal to or higher than the Curie temperature.

In FIG. 11, assume that the temperature of the fixing roller 92 is equal to or higher than the Curie temperature. As described above, the third switching element 351 is OFF, and a threshold input to the second comparator 3002 is VrbH. If an abnormal status occurs in the coil 91 and an output current becomes an overcurrent state, the voltage Viout corresponding to output current that is input from the output current detection unit 317 to the second comparator 3002 rises. If the voltage Viout corresponding to output current exceeds VrbH, an output from the second comparator 3002 changes from Low to High, and an error signal indicating an abnormal status is input to the control unit 400. The control unit 400 then stops the operation of the power source device 300, as described above with reference to FIG. 5.

Figure 12:
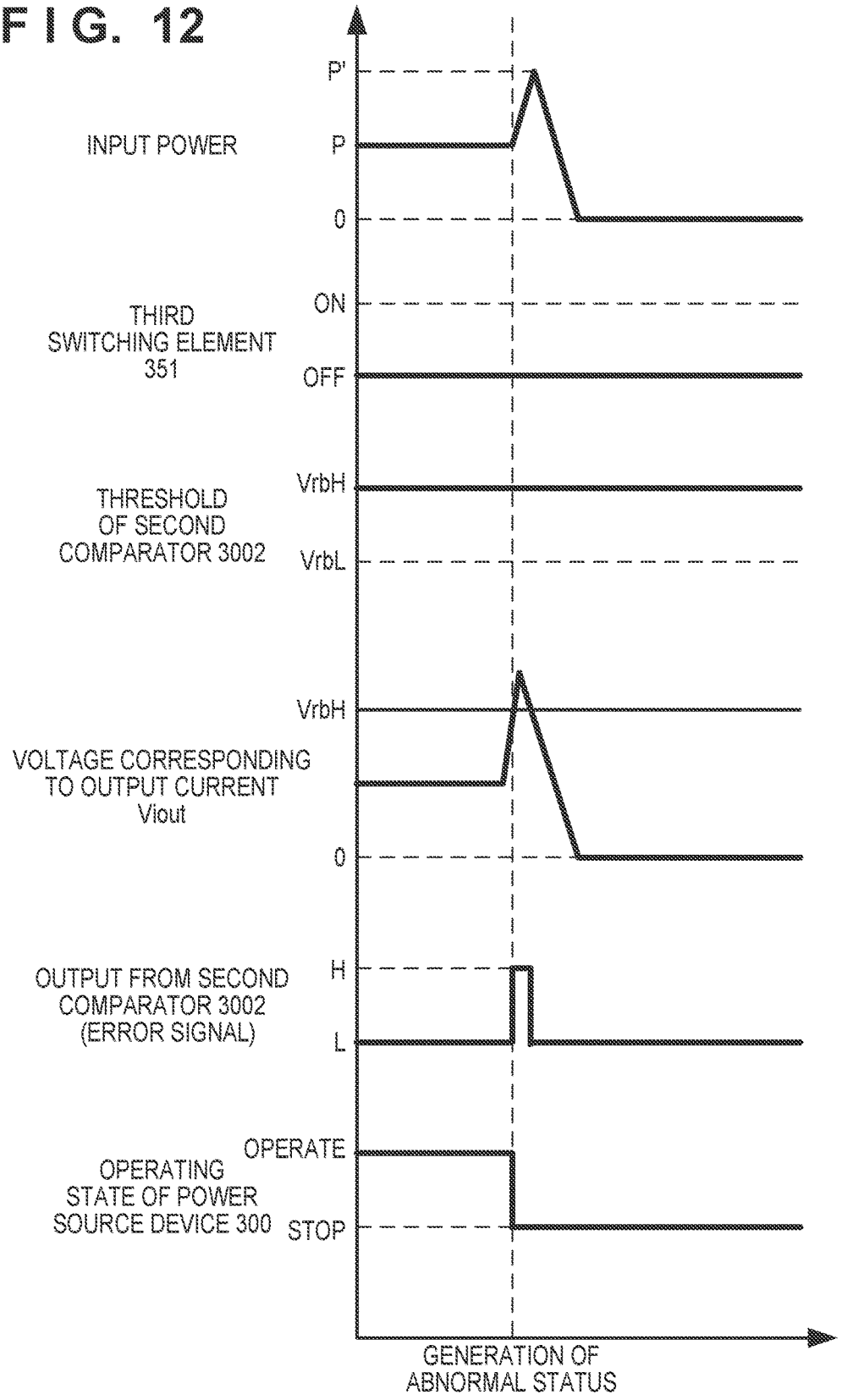
FIG. 12 is a chart showing the state of each portion of the apparatus when input power to the power source device enters an overcurrent state at a temperature equal to or higher than the Curie temperature.

In FIG. 12, assume that the temperature of the fixing roller 92 is equal to or higher than the Curie temperature. As described above, the third switching element 351 is OFF, and a threshold input to the second comparator 3002 is VrbH. If input power enters an overcurrent state, a current flowing through the coil 91 also increases, and the voltage Viout corresponding to output current that is input from the output current detection unit 317 to the second comparator 3002 rises. If the voltage Viout corresponding to output current exceeds VrbH, an output from the second comparator 3002 changes from Low to High, and an error signal indicating an abnormal status is input to the control unit 400. Hence, the control unit 400 stops the operation of the power source device 300, as described above with reference to FIG. 5.

As described above, the threshold used to determine the abnormal status of an output current by the output overcurrent detection unit 318 is changed based on the temperature of the fixing roller. An abnormal status can be appropriately detected regardless of the temperature of the fixing roller 92. By selecting each threshold, the power source device can be stopped when power exceeds almost constant reference power regardless of the temperature of the fixing roller 92.

OTHER EMBODIMENTS

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-278397, filed Dec. 14, 2010, which is hereby incorporated by reference herein in its entirety.

What is claimed is:

1. An image forming apparatus for setting different current shut-off thresholds for temperatures of a magnetic material thereof above and below the Curie temperature, comprising:

a magnetic flux generating device configured to generate a magnetic flux;

a fixing unit configured to generate heat in accordance with the magnetic flux from the magnetic flux generating device, the fixing unit having a heating element including the magnetic material heated by the magnetic flux from the magnetic flux generating device;

a power source configured to supply a current to the magnetic flux generating device;

a current detection unit configured to detect a value of the current supplied to the magnetic flux generating device;

a temperature sensor configured to detect a temperature of the heating element;

an output overcurrent detection unit that receives the output of the temperature sensor and the output of the current detection unit, wherein the output overcurrent detection unit generates a first threshold value for comparing to a value representing the current value supplied to the magnetic flux generating device if the heating element is below the Curie temperature, and generates a second threshold value for comparing to a value representing the current value supplied to the magnetic flux generating device if the heating element is above the Curie temperature, wherein the output overcurrent detection unit outputs an abnormal status signal, instructing stopping current supply from the power source to the magnetic flux generating device, i) when the value representing the current value detected by the current detection unit is above the first threshold value and the temperature of the heating element detected by the temperature sensor is below the Curie temperature, and ii) when the value representing the current value detected by the current detection unit is above the second threshold value, and the temperature of the heating element detected by the temperature sensor is above the Curie temperature; and a control unit receiving the abnormal status signal from the output overcurrent detection unit and stopping the supply of the current to the magnetic flux generating device from the power source in response to receiving the abnormal status signal from the output overcurrent detection unit.

2. The apparatus according to claim 1, wherein the first threshold value and the second threshold value are determined such that a power supplied to the magnetic flux generating device at a time when the output overcurrent detection unit outputs the abnormal status signal is constant, regardless of whether the temperature detected by the temperature sensor exceeds the Cure temperature.

3. The apparatus according to claim 1, wherein the output overcurrent detection unit includes a comparison unit configured to compare the value representing the current value detected by the current detection unit to the threshold value set by the output overcurrent detection unit.

4. The apparatus according to claim 1, wherein the magnetic flux generating device is a coil that generates a magnetic field by a current flowing in the coil.

5. The apparatus according to claim 1, wherein the power source comprises:

a switching element configured to supply a current to the magnetic flux generating device; and a driving signal generating unit configured to generate a driving signal for driving the switching element, and wherein the control unit is further configured to control the driving signal generating unit such that the driving signal generating unit stops generating the driving signal when the output overcurrent detection unit outputs the abnormal signal indicting the error.

6. The apparatus according to claim 1, wherein the second threshold value is greater than the first threshold value.

* * * * *